US005520056A

United States Patent [19]

Buisson et al.

[11] Patent Number: 5,520,056

[45] Date of Patent: May 28, 1996

[54] PROCESS FOR CONDITIONING AND FOR PLACING A TRAFFIC SENSOR

[75] Inventors: Claude Buisson, Grand Couronne; Daniel Fillastre, Belbauf; Erice Violette, Grand Couronne, all of France

[73] Assignee: Etat Francais, France

[21] Appl. No.: 252,470

[22] Filed: Jun. 1, 1994

Related U.S. Application Data

[63] Continuation-in-part of Ser. No. 221,007, Apr. 1, 1994, abandoned.

[30] Foreign Application Priority Data

Apr. 1, 1993 [FR] France ..... 93 03840

[51] Int. Cl.[6] ..... G08G 1/042

[52] U.S. Cl. ..... 73/784; 340/933

[58] Field of Search ..... 73/786, 866.5, 73/DIG. 4, 784; 310/338, 340, 345, 348; 340/933

[56] References Cited

U.S. PATENT DOCUMENTS

| | | | |
|---|---|---|---|
| 2,842,687 | 7/1958 | Van Dyke | 310/345 |
| 3,974,474 | 8/1976 | Izzo | 340/10 |
| 4,383,239 | 5/1983 | Robert | 340/933 |
| 4,966,031 | 10/1990 | Mochizuki | 73/35 |
| 5,196,846 | 3/1993 | Brockelsby et al. | 340/933 |
| 5,265,481 | 11/1993 | Sonderegger et al. | 340/933 |
| 5,305,507 | 4/1994 | Dvorsky et al. | 310/340 |

*Primary Examiner*—Robert Raevis

*Attorney, Agent, or Firm*—Millen, White, Zelane, & Branigan

[57] ABSTRACT

Process for packaging a sensor (1) to be placed in a road (2), characterized in that it consists in covering said sensor (1) with threads (8) of organic or inorganic material extending over the entire length of sensor (1) and in burying the whole in a binder that hardens by polymerization, so as to obtain a bar (7) containing said sensor (1).

25 Claims, 1 Drawing Sheet

PROCESS FOR CONDITIONING AND FOR PLACING A TRAFFIC SENSOR

CROSS-REFERENCE TO RELATED APPLICATION

This application is a continuation-in-part of Application Ser. No. 08/221,007, filed Apr. 1, 1994, (now abandoned).

BACKGROUND OF THE INVENTION

This invention relates to a process for conditioning a traffic sensor to be placed across a road transversely to to the direction of circulation of cars and trucks.

It applies more particularly to sensors that by their positioning in the road must be protected from the static or dynamic load stresses that the road undergoes. Among these sensors, the invention finds a very particular advantage for sensors requiring an installation over a considerable length, in particular the width of the road or the width of a traffic band, such as for example sensors for passage of axle assemblies.

Conventionally, sensors sensitive to the passage of axle assembles are of the piezoelectric type, so that they supply data as voltage pulses in an electric signal in correspondance with the pressure variations caused by the weight of axle assemblies at the passage of vehicles. They consist of a conductive core covered with piezoelectric ceramic in a coaxial conductive tubular shield and they are connected at one or both ends to external circuits for electric supply and treatment of the electric signals delivered.

The most frequent sensors are of the piezoelectric, capacitive, resistive or inductive type and are connected by a coaxial electric cable to a system for ensuring electric current supply and treating the outlet electric signals that reflect the measurements. This electric signal is generally delivered to one end of the sensor by means of a coaxial cable connected by its core to the core of the sensor, its shielding being at the mass or ground voltage.

Conventionally, the sensors are conditioned for their placement in the road in an aluminum U shape profile filled with a mixture of sand and of resin wherein they are embedded. The structural self-supporting bar thus obtained is then placed in a trench made in the road and also filled with a mixture of sand and resin; the sensor, its encapsulating mass and the trench extending over the width of the road.

The drawback of this technique resides in the fact that the bar containing the sensor undergoes considerable stresses, particularly shearing stresses during passage of vehicles on the road, and in the fact that it breaks under the effect of these stresses particularly because of the different moduli of elasticity that, on the one hand, the sand and resin mixture possesses while sand and resin are in approximately equal proportions and, on the other hand, the surfacing or pavement and the foundation layers of the road.

It has been proposed to attempt to absorb these stresses by providing the bar laterally with foam cover layers, but this solution is not satisfactory, since there exists the need to have a sensor encapsulated or embedded so that shows sufficient hardness in relation to the purpose of the sensor such as for example dynamic weighing, such hardness being necessary so as not to disturb the electric signal issuing from the sensor.

SUMMARY OF THE INVENTION

The governing idea of this invention is to impart to the sensor some flexibility in order to reduce the dangers of breaking the sensor, while maintaining a good hardness and mechanical strength for the reliability of the measurements, through encapsulating it in an appropriate embedding mass either prior to or in situ during its placement into a trench across the road.

To do this and according to its main characteristic, this invention relates to a process for conditioning a traffic sensor that comprises at least one step of encapsulating said sensor in a strengthening organic mass comprising threads of organic or inorganic material extending continuously and unidirectionally over the entire length of the sensor and enveloping said sensor all around.

According to a first mode of implementation of the invention, such encapsulation of a sensitive element to be placed in a road transversely to the traffic path is performed in a separable mold, the process comprising enveloping said element all around with threads of organic or inorganic material extending continuously and unidirectionally over the entire length of the element and in embedding the whole in a binder composition that hardens by polymerization, so as to obtain a self supporting three-dimensional structural bar detector incorporating said sensitive element inside the cured embedding mass.

The bar thus obtained possesses a certain flexibility thanks to the cohesion provided by the threads that extend over the entire length of the bar. It is nonetheless hard and resistant due to the effect of the polymerization of the binder, which can be selected from this characteristic according to criteria known to those skilled in the art. The binder can be preferably an epoxy resin.

Among the organic or inorganic materials that can be used for the threads, such as carbon, Kevlar (trade name), glass or a combination of various fibers, it will be preferred to use glass threads because, in addition to their low cost, they impart on the one hand better flexibility in comparison with carbon threads and, on the other hand, they are easier to handle in the process compared to Kevlar threads.

Glass threads thus used for covering the sensor all around inside the encapsulating composition impart excellent quality of flexibility and mechanical strength to the bar, especially when being disposed without weaving or entwining unidirectionally parallel to the sensor, but grouped into bundles that are softly assembled together to form individual unidirectional sheets of threads.

In practice, a mold is used that is filled with class threads and in which the sensor is positioned, then the binder composition consisting of a mixture of epoxy resin and a hardening agent is injected so as to fill all voids between the threads or the threads and the sensor, and after curing through polymerization, a self supporting detector bar is obtained.

Care will preferably be taken during that encapsulating operation to make sure that the sensor is kept in a position in which it is at constant distance over its entire length from a face of the bar which, preferably, has a parallelepiped cross section. This keeping in position can, for example, be assured by applying axial tension efforts to tighten the sensor while it is in the mold, or by placing centering elements at intervals along the sensor. Such centering elements can advantageously be made of an organic material compatible with the polymerizable binder and having a form such that it does refrain the encapsulating composition to penetrate and circulate so as to fill in all voids and avoid the apparition of air bubbles in the encapsulating mass.

This positioning is of importance considering the application for which the sensor is intended so that once placed in the road, it is approximately equidistant from the surface of the road over its entire effective length, from over the length where it must be sensitive to supply information.

Since the sensor should be connected by one of its ends to an electrical connection cable, it is advantageously provided, with again an eye to avoiding the dangers of breaking, to surround this end with a flexible protective sleeve so as not to render the cable or the connection with the sensor at the limit of the bar brittle or fragile during placement in the road. In case the encapsulated sensor requires electrical connection at both its ends, a sleeve surrounding the connection will be provided at each end.

The above process leads to a traffic detector according to the invention which is characterized in that it consists of a self-supporting bar comprising a rectilinear piezoelectric sensor element centered axially in a stratified encapsulating mass which comprises continuous threads extending longitudinally over all the length of the sensitive element, said threads being tightly embedded with the sensitive element in a cured composition comprising a polymerizable binder.

In comparison with the bars of the prior art of same dimensions, a detector bar according to the invention shows a breaking resistance that is considerably higher because of the flexibility that is imparted to it. In addition, there is no longer any need to resort to an aluminum jacket as was necessary in the prior art because of slight cohesiveness of the bar over its length, since cohesiveness is now inherent to the bar itself.

According to a further implementation of the invention, the encapsulating step is performed in situ by molding it in a trench accross a road. Conditioning of the sensor is thus performed as a process for placing a traffic detector in a road. Said detector can either a simple sensitive element not yet encapsulated, or a sensor encapsulated into a bar according to the prior art, or preferably a bar detector of the invention as described above.

Thus the invention can also be implemented as a process for placing a traffic detector as a longitudinally extending sensitive element or bar including said element transversely accross a road which due to similar use of longitudinally extending not woven threads meets substantially the same aims as explained above, namely imparting to the bar once placed a certain flexibility to limit the dangers of breaking the sensor while maintaining good hardness and mechanical strength for reliability of the measurements.

Such process preferably comprises the steps of:

making, in the road, a trench with a cross section considerably greater than the cross section of said detector;

preparing in the bottom of the trench, a lower base layer consisting of at least one unidirectional sheet of non woven long threads of organic or inorganic material in a composition hardenable by polymerization of an organic binder and advantageously charged with short fibers of organic or inorganic material;

positioning said detector on said lower base layer by keeping it by means of brackets resting on the edges of the trench to prevent it from being driven into said base layer during curing of said composition;

preparing on said bar an upper covering layer similar to said lower base layer and ended on top by a finishing layer consisting of said composition that is flush with the road;

letting said composition harden by curing it through polymerization of the binder.

For the placement in the road of the composite bar according to the invention, use is therefore also made of threads of organic or inorganic material but that are here preferably brought together in sheet to facilitate the use of the process which must be performed on the installation site of the sensor. Further, this makes it possible to obtain a layer of threads extending beyond the sensitive element over the entire length of the trench that thus impart to the whole a good mechanical strength and a cohesiveness over the entire length of the trench.

The fact of using a nonwoven unidirectional sheet in which bundles of threads are connected by weft insertion, aims at an improved natural bed by not creating an obstacle for the pouring of the binder thus making possible a better cohesiveness.

Advantageously, the organic binder used is in a composition charged with fibers of organic or inorganic material. As is well known in the field of glass products, such fibers are non uniform and short, with length generally less than 1 cm, whereas threads are produced as continuous material over length of 1 m or more. Furthermore, a fiber charge will have rough short fibers irregularly in all directions and crossed to each other, whereas the strengthening threads as used in the invention have a length of 1 m at least and are extending continuously substantially parallel to each other.

For reasons similar to those explained for the manufacture of the bar, the threads of the sheets as well as the fibers in the binder are made out of glass prerably to other inorganic material or organic materials.

According to a particularly advantageously characteristic of the placement process according to the invention, said composition consists of a charge of glass fiber and sand and a polymerizable binder having an epoxy resin base.

The use of sand in the charge makes it possible to absorb partially the heat released by the polymerization of the resin and thus to limit the effects of it. Actually, it is desired to control the exothermy during the polymerization, on the one hand because of the use of the process in a road that can contain foundation layers or a pavement sensitive to temperature and, on the other hand to prevent an expansion of the structure installed in the trench while would induce a raised area of the surface of the road at this very place.

In this same context, a forced ventilation of the surface of the road is preferably set up at the location of the trench to help to remove the heat produced by the polymerization.

To strengthen the performance of the structure installed in the road and therefore facilitate the anchoring of this structure in the trench, this trench is preferably made in undercut shape of approximately trapezoidal form directed toward the top of the road.

In this same contact, care will advantageously be taken during the making of the trench that its bottom does not correspond with an edge between two constituent layers of this road, or two foundation layers or the pavement and the final foundation layer.

The structure obtained by the use of the placement process according to the invention is particularly suitable for the applications for which it is intended while considerably improving the service life of the sensors thus installed.

Preferably, the base and covering layers each comprise at least three layers of thread sheet, the maximum number of layers of sheets depending on the intensity of the dynamic stresses that the structure is to undergo and on the depth of the trench.

BRIEF DESCRIPTION OF THE DRAWINGS

Below in more detail, a particular embodiment of the invention will be described that will make the essential characteristics and the advantages better understood, it being understood however that this embodiment is selected by way of example and that it is in no way limiting. Its description is illustrated by the accompanying drawings in which.

For reasons of clarity, the same elements have been designated by the same references in all figures.

DETAILED DESCRIPTION OF THE FIGURES

Figures 1, 2, 3, 4:
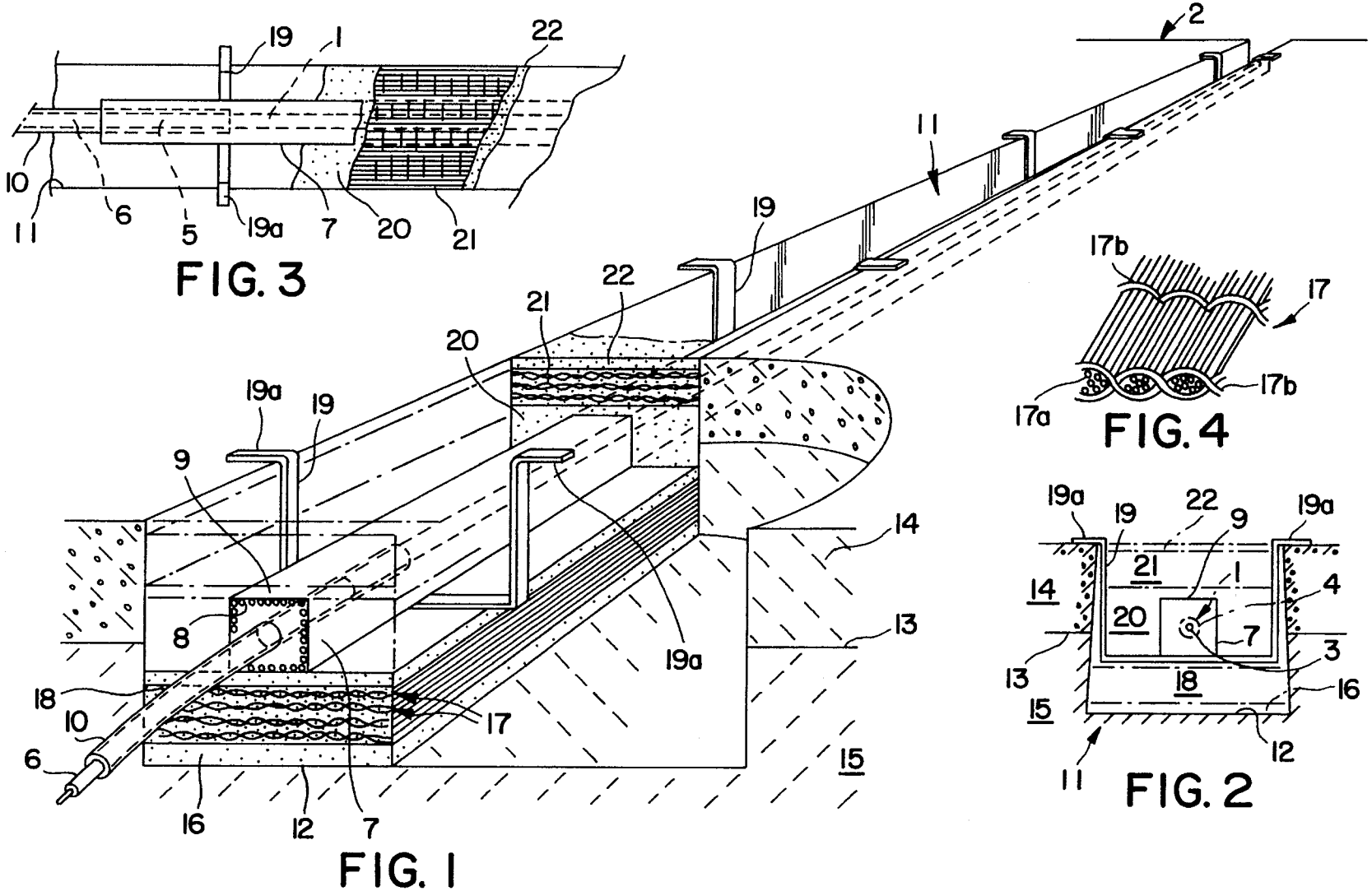
FIG. 1 is a torn-away view in perspective of a composite bar made and placed in a road according to the invention.
FIG. 2 is a view in cross section of the structure represented in FIG. 1.
FIG. 3 is a torn-away top view of the structure represented in FIG. 1.
FIG. 4 is a partial view in perspective of a detail of the structure represented in FIG. 1.

The example of embodiment represented in the figures applies to the conditioning and to the placement of a long-shaped sensor 1 that must be placed transversely in a road 2 such as for example a sensor intended to measure the dynamic load supported by the road.

As represented in FIG. 1, sensor 1 extends therefore over the entire width of road 2 or at least over the entire width of a strip of this road on which the measurements must be made. Current dimensions are within the range from 1.5 to 6 meters, for instance 1.7 or 3.2 meters.

Sensor 1 is a sensor of a type known in the art consisting for example of a metal core 3 covered with ceramic layer 4 (FIG. 2) and is connected at one of its ends 5 (FIG. 3) to a cable (6), for example of coaxial type, for connection to a computer system using the electric signals to calculate measurements. The outer shields are at ground voltage.

The sensor 1 is conditioned according to the invention in the form of a composite bar 7 made by covering the sensor with glass threads 8 extending over the entire length and by embedding the whole in a binder that hardens by polymerization of an epoxy resin.

This bar, made for reasons of convenience in a parallelepiped shape, is obtain from a mold (not shown) that is filled with glass threads 8, generally presented in bundles each containing from 5 to 100, preferably from 10 to 50 threads, considering their slight diameter (which is lower than 0.5 mm, for instance within the range from 0.1 to 0.5 millimeters). Thence it is preferably made use of layers of glass threads known commercially as unidirectional sheets wherein a number of such bundles are assembled together parallel to each other using some fiber material loosely interlaces around the bundles from place to place along them.

The sensor 1 is positioned in the mold while taking care that over its entire length it is equidistant from one of the faces of the mold, more particularly from the face which will correspond for the finished bar 7 to its top face 9 when placed in the road 2.

This equidistance can be obtained by maintaining the sensor axially in the center of the mold which advantageously makes it possible not to have to locate a determined face on the finished bar for it to be placed in the road and to make, without risk to the reliability of the measurements, a bar operating as a cylindrically sensitive detector.

In practice in the example described, the sensor has a diameter of 3 mm (which could be from 1 to 10 mm in other cases) and the mold is fully filled with glass threads around the sensitive element. This is obtained by placing a first series of unidirectional sheets, then the sensor, then a second series of sheets. The number of sheets in each series is from 10 to 30, and their bundles place by themselves in alternate position, so that it can be observed finally that the sensor is completely surrounded with threads. Seen in cross-section, it can be admitted that a least a dozen of threads will face each point or the sensor on a thickness substantially equal to its diameter.

In practice also, two or three pieces of an organic material compatible with the binder and clasped onto the sensor at different places along it will be sufficient to maintain the sensor in place laterally, while, vertically, it is supported in the correct place by the a accumulated in the mold.

The end of sensor 1 which is connected to connection cable 6 is sheathed with a flexible sleeve 10 for protection of the connection. This sleeve 10 extends toward cable 6 to protect this cable 6 also over the portion of its length that could be contained in bar 7 and in the structure that will be made during the placement of bar 7 in road 2.

Once glass threads 8 and sensor 1 are placed in the mold, the latter is closed and injection of the binder with an epoxy resin base is performed. Injection can, for example, occur from one of the ends of the mold by suction with a vacuum pump at the other and, so as to obtain a uniform dense filling penetrating all around threads and sensor and not leaving any void or air bubbles.

After polymerization of the resin and removal of the mold, composite bar 7 is obtained which, while exhibiting a sufficient hardness by the resin used, offers a good resistance to breaking thanks to the flexibility and the cohesiveness over its entire length provided by glass threads 8.

By way of example, for a bar of square cross section 15 mm×15 mm with a length of 3 m, the breaking threshold obtained is 650 Kg and the flexion is not higher than 30 mm while a bar of the previous art exhibits with no flexion a breaking threshold at 200 Kg.

For the placement of bar 7 thus obtained in road 2, a trench 11 over the entire width of road 2 is made according to the invention. This trench 11 can be made by any conventionally used means. However, care will be taken to make sure that bottom 12 of trench 11 does not correspond with edge 13 between pavement 14 and final foundation layer 15 of road 2 or, if the bar is placed more deeply, between two foundation layers of the road.

In this same context, to assure a better performance in the structure produced, trench 11 is preferably made in undercut shape, i.e., it exhibits a trapezoidal-shaped cross section directed toward the top of road 2, as is seen in FIG. 2. The inclination of the walls of the trench does not need to be great, it has only the aim of preventing any danger of heaving up of the structure produced. This inclination can be replaced with irregularities left in the lateral walls of the trench making posible an anchoring of the structure when it is hardening.

A first layer 16 of a previously prepared composition having a base of an organic binder that hardens by polymerization of an epoxy resin, and charged with sand and glass fibers, is then poured in trench 11. This first layer 16 is distributed on bottom 12 with a sufficient thickness to make up for the differences of level and of irregularities that come from the making of trench 11.

By glass fibers or small glass fibers are meant sections of slight length that can be incorporated into the composition without hampering the fluidity that is desired for it to be poured into the trench and to closely envelop the glass threads. Their direction is not controled.

Then by successive layers, nonwoven sheets 17 of glass threads are deposited, on each of which a new layer of the composition is poured so as to obtain a lower base layer 18. This base layer 18 preferably comprises a number of sheets 17 between 3 and 10 depending on the depth of trench 11 and on the level at which it is desired to place bar 7.

Sheets 17 of glass threads (FIG. 4) consist of bundles 17*a* of non-entwined, non-twisted and unidirectional threads so that the sheets are buried in the composition more easily; the bundles being connected to one another by a weft insertion 17*b* to facilitate their placement. The number of bundles 17*a* of each sheet 17 depends on the width of trench 11 and on the cross section of the bundles 17*a*, it is for example between 5 and 15.

The bar 7 is then positioned in the trench with U-shaped brackets 19 that are flush with base layer 18 and that are suspended by resting by edges 19*a* that they have on the top of road 2. These brackets have as their object to prevent the driving of bar 7 into base layer 18 during the hardening of the composition.

An intermediate layer 20 of the composition is poured to cover bar 7 and an upper covering layer 21 is made in a manner similar to lower base layer 18, i.e., by depositing of successive layers of sheets 17 of glass threads on each of which a layer of the composition is poured. In practice, while it is not clear from the figures, both layers meet on the sides of the bar. The covering layer 21 is ended by a finishing layer 22 of the composition that is flush with the top of road 2.

Once the structure thus made is hardened, i.e., at the end of the polymerization of the resin contained in the composition, brackets 19 are cut off flush with road 2 to eliminate their edges 19*a* and thus obtain a continuity of the surface of road 2.

By way of example, for a bar 7 of square cross section 15 mm×15 mm, a trench 11 with a depth of 70 mm and a width of 50 mm will be made.

The proportions used in the hardening composition are, for example, those of a charge consisting in relation to the volume of the composition from 10 to 40% glass fibers, from 10 to 40% sand, and from 20 to 80% binder with an epoxy resin base.

To prevent an expansion of the structure under the effect of the heat release by the polymerization and although this release of heat is already limited by the addition of sand in the charge of the composition, a forced ventilation of the surface of road 2 is set up at the level of trench 11.

For example, for this purpose a tunnel (not shown) of sheet metal or of plastic placed on the road over the entire length of trench 11 is used and a fan is placed at one of its ends to cause a circulation of forced air and thus remove the released heat. This tunnel also has the role of protecting the surface of the structure when it is hardening, from rain and from foreign bodies that could deposit on its surface.

The complete detection system finally obtained can operate much longer than sensors conditioned as in the prior art when used in similar qualities of road and similar traffic. Further, it can be used safely in roads of comparatively bad quality and they will follow progressive deflexion of the road without breaking. In an example wherein the encapsulation is performed in situ using glass threads as described above, with a conventional detector as the bar, it can be observed that weights up to 19 tons are supported before encountering a risk or rupture, which could then occur through destruction or the threads continuity, whereas a similar bar embedded in a composition comprising resin, sand, and fibers, but no threads would break by weight charges if 9 tons.

Of course, the invention is in no way limited to the examples of embodiment described above.

In particular the conditioning process with a first encapsulating step as a bar and/or a second encapsulating step in situ during the placement process in the road, can be used with other types of sensors, for example localized sensors buried in the placement structure. Also, the glass fibers and the glass threads can be replaced by other organic or inorganic materials provided that these materials meet the same objects, and the sand could be replaced by another charge, such as for example silica gel provided that this charge fulfills the desired functions.

Also, although the placement process has been described for an embodiment flush with the pavement of the road, this process can be applied to the placing of sensor in a foundation layer during the making of the road, the structure being then covered by the pavement of the road.

What we claimed is:

1. A process for conditioning a traffic sensor comprising at least one step of encapsulating said sensor in a strengthening organic mass comprising threads of organic or inorganic material, said threads consisting essentially of substantially parallel threads extending continuously in the same direction over the entire length of the sensor and enveloping said sensor all around.

2. A process according to claim 1, wherein encapsulation of a sensor to be placed in a road transversely to the traffic path is performed in a removable mold, said process comprising enveloping said sensor all around with said substantially parallel threads of organic in inorganic material extending continuously and unidirectionally over the entire length of the sensor and embedding the enveloped sensor in a binder composition that hardens by polymerization, so as to obtain a self supporting three-dimensional structural bar detector incorporating said sensor inside the cured embedding mass.

3. A process according to claim 2, wherein said mold has a parallelepiped cross section and said threads are glass threads comprising filling said mold with said glass threads (8);

positioning the sensor (1) in said mold equidistant over the entire length thereof from a face of the mold;

closing the mold;

injecting said binder composition into the closed mold so as to obtain, after polymerization of said binder composition and removal of the mold, a resultant bar (7) containing said sensor (1).

4. A composite bar containing a sensor (1) as obtained by using the process according to claim 3.

5. A process according to claim 3, comprising connecting at least one end (5) of said sensor to an electrical connection cable (6), and prior to the positioning of said sensor in the mold, surrounding said sensor with a flexible sleeve (10) for protection of the connection between said sensor (1) and said cable (6), said sleeve (10) extending out of the end of said bar (7).

6. A composite bar containing a sensor (1) as obtained by the process according to claim 5.

7. A process for placement in a road (2) of a traffic sensor in the form of a bar (7) according to claim 2, comprising:

digging, in a road (2), a trench (11) with a cross section considerably greater than the cross section of said bar (7);

providing in bottom (12) of the trench (11), a lower base layer (18) comprising at least one sheet (17) of nonwoven threads (17*a*) of organic or inorganic material embedded in a hardenable polymeric binder composition containing reinforcing fibers of organic or inorganic material;

positioning U-shaped brackets (19) in the trench, said brackets being suspended by edges thereof (19*a*) in the road, the bottom of the brackets being flush with the base layer;

in positioning said bar (7) on said brackets (19) resting on the edges of trench (11) to prevent said bar from being driven into said base layer (18) during the hardening of said composition;

covering said bar (7) with an upper covering layer (21) similar to said lower base layer (18);

and applying a finishing layer (22) comprising said binder composition that is flush with road (2).

8. A traffic sensor placed in a road as obtained by the process according to claim 7.

9. Process according to claim 7, wherein said base (18) and covering (21) layers each have at least three layers of sheet (17) of threads (17*a*).

10. Process according to claim 9, wherein said thread sheets (17) are sheets of glass threads.

11. Process according to claim 9, wherein said reinforcing fibers the composition are glass fibers.

12. Process according to claim 7, wherein said threads sheets (17) are sheets of glass threads.

13. Process according to claim 12, wherein said composition comprises of a charge of glass fiber and sand and a binder having an epoxy resin base that can be polymerized.

14. A process according to claim 2, wherein said threads (8) are glass threads.

15. A composite bar containing a sensor (1) as obtained by the process according to claim 2.

16. A process according to claim 1, wherein said threads (8) are glass threads.

17. A composite bar containing a sensor (1) as obtained by the process according to claim 16.

18. A traffic sensor comprising a self-supporting bar comprising a rectilinear piezoelectric sensor having a longitudinal axis and centered axially in a stratified encapsulating mass which comprises threads, said threads consisting essentially of substantially parallel threads extending substantially parallel to the longitudinal axis over substantially all the length of the sensor, said threads being tightly embedded with the sensor in a cured composition comprising a polymerizable binder.

19. A traffic sensor according to claim 18, wherein the threads have the length of at least one meter.

20. A traffic sensor according to claim 19, wherein said threads have a diameter of less than 0.5 millimeters.

21. A traffic sensor according to claim 20, having a diameter of 1–10 millimeters.

22. A traffic sensor according to claim 21, wherein said threads are glass.

23. A process for placement in a road (2) of a traffic sensor in the form of an encapsulated bar (7) reinforced by substantially parallel threads along the longitudinal axis of said bar, said process comprising digging, in a road (2), a trench (11) with a cross section considerably greater than the cross section of said bar (7);

providing in bottom (12) of the trench (11), a lower base layer (18) comprising at least one sheet (17) of non-woven threads (17*a*) of organic or inorganic material embedded in a hardenable polymeric binder composition containing reinforcing fibers of organic or inorganic material;

positioning U-shaped brackets (19) in the trench, said brackets being suspended by edges thereof (19*a*) in the road, the bottom of the brackets being flush with the base layer;

positioning said bar (7) on said bracket (19) resting on the edges of trench (11) to prevent said bar from being driven into said base layer (18) during the hardening of said composition;

covering said bar (7) with an upper covering layer (21) similar to said lower base layer (18);

and applying a finishing layer (22) comprising said binder composition that is flush with road (2).

24. A traffic sensor placed in a road as obtained by the process according to claim 23.

25. A traffic sensor according to claim 24, wherein said threads have a length of at least one meter and wherein said fibers have a length of less than one centimeter.

* * * * *